US010322870B1

(12) United States Patent
Knight et al.

(10) Patent No.: US 10,322,870 B1
(45) Date of Patent: Jun. 18, 2019

(54) ENCLOSED CONTAINER WITH REMOVABLE SIDES

(71) Applicants: Steven J. Knight, Mission Hill, SD (US); Jason Eugene Anderson, Yankton, SD (US)

(72) Inventors: Steven J. Knight, Mission Hill, SD (US); Jason Eugene Anderson, Yankton, SD (US)

(73) Assignee: Shur-Co, LLC, Yankton, SD (US)

( * ) Notice: Subject to any disclaimer, the term of this patent is extended or adjusted under 35 U.S.C. 154(b) by 125 days.

(21) Appl. No.: 15/468,379

(22) Filed: Mar. 24, 2017

(51) Int. Cl.

| | |
|---|---|
| ***B65D 90/58*** | (2006.01) |
| ***B65D 88/20*** | (2006.01) |
| ***B65D 88/52*** | (2006.01) |
| ***B65D 88/22*** | (2006.01) |
| ***B65D 90/02*** | (2019.01) |

(52) U.S. Cl.
CPC ..... *B65D 88/526* (2013.01); *B65D 88/20* (2013.01); *B65D 88/22* (2013.01); *B65D 90/021* (2013.01)

(58) Field of Classification Search
CPC ..... B65D 88/526; B65D 88/20; B65D 88/22; B65D 90/021
USPC ..... 160/290.1, 328, 349.1, 378; 220/4.33, 220/1.5
See application file for complete search history.

(56) References Cited

U.S. PATENT DOCUMENTS 2,218,451 A * 10/1940 Heyne ..... B41F 15/36 101/127.1
4,817,317 A * 4/1989 Kovalak, Jr. ..... G09F 13/04 40/549
5,140,765 A * 8/1992 King ..... G09F 15/0025 40/574
5,466,030 A * 11/1995 Harris ..... B60J 5/067 160/243
6,041,535 A * 3/2000 Holloway ..... G09F 15/0025 160/328
6,101,751 A * 8/2000 Hicks ..... G09F 21/048 160/328
6,782,646 B1 * 8/2004 Devaney ..... G09F 15/0025 40/590
7,810,545 B2 * 10/2010 Bernardi ..... E04B 9/303 160/328
8,191,606 B2 * 6/2012 Edlin ..... E06B 9/52 160/328
9,051,774 B1 * 6/2015 Acker, Jr. ..... E05D 15/0626

* cited by examiner

*Primary Examiner* — J. Gregory Pickett
*Assistant Examiner* — Niki M Eloshway
(74) *Attorney, Agent, or Firm* — Jeffrey A. Proehl; Woods, Fuller, Shultz & Smith, PC

(57) ABSTRACT

A container may comprise a support frame with sides and at least one of the sides being an open side defining an opening, a flexible panel configured to at least partially cover the open side of the support frame, and a panel mounting assembly configured to removably mount the panel over the opening. The panel mounting assembly may comprise at least one panel mounting element including a leverage structure configured to provide a fulcrum edge along at least a portion of the opening, with the at least one portion of the panel being tensionable over the fulcrum edge. The panel mounting element may also comprise a tensioning structure mountable on the leverage structure and configured to selectively apply tension to the at least one portion of the panel with the thicker thickness over the fulcrum edge of the leverage structure.

20 Claims, 5 Drawing Sheets

ENCLOSED CONTAINER WITH REMOVABLE SIDES

BACKGROUND

Field

The present disclosure relates to containers and more particularly pertains to a new enclosed container with removable sides for permitting inspection of items within the container that may otherwise be difficult to inspect.

SUMMARY

In one aspect, the disclosure relates to a container configured to contain at least one object in an interior, with the container having a top, a bottom, a first side, a second side opposite of the first side, a first end side, and a second end side opposite of the first end. The container may comprise a support frame with sides corresponding to the sides of the container, with at least one of the sides being an open side defining an opening and the open side of the support frame comprising a perimeter frame including a plurality of frame members forming a substantially rectangular shape. The container may comprise a flexible panel configured to at least partially cover the open side of the support frame. The panel has a periphery and a peripheral section located adjacent and along the periphery, and the peripheral section may include a plurality of portions, with at least one portion of the peripheral section having a thicker thickness relative to a thickness of a remainder of the panel. The container may also include a panel mounting assembly configured to removably mount the panel over the opening of the open side of the support frame, and the panel mounting assembly may comprise at least one panel mounting element comprising a leverage structure configured to provide a fulcrum edge along at least a portion of the perimeter frame of the open side of the support frame, and the at least one portion of the peripheral section being tensionable over the fulcrum edge. The panel mounting element may also include a tensioning structure mountable on the leverage structure and configured to selectively apply tension to the at least one portion of the panel with the thicker thickness over the fulcrum edge of the leverage structure.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components, and well as the particulars of any steps set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
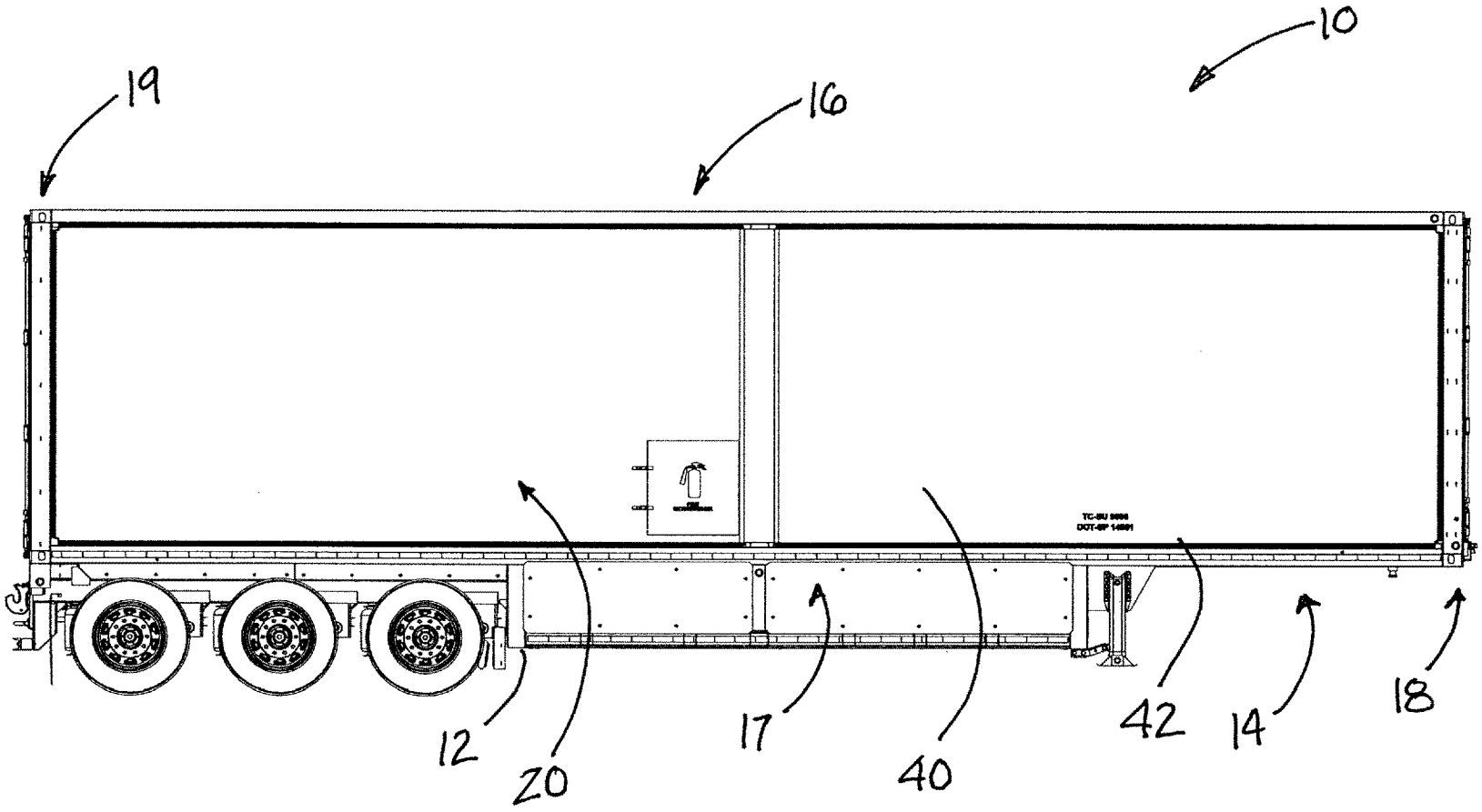
FIG. 1 is a schematic side view of a new system having an enclosed container with removable sides according to the present disclosure.
Figure 2:
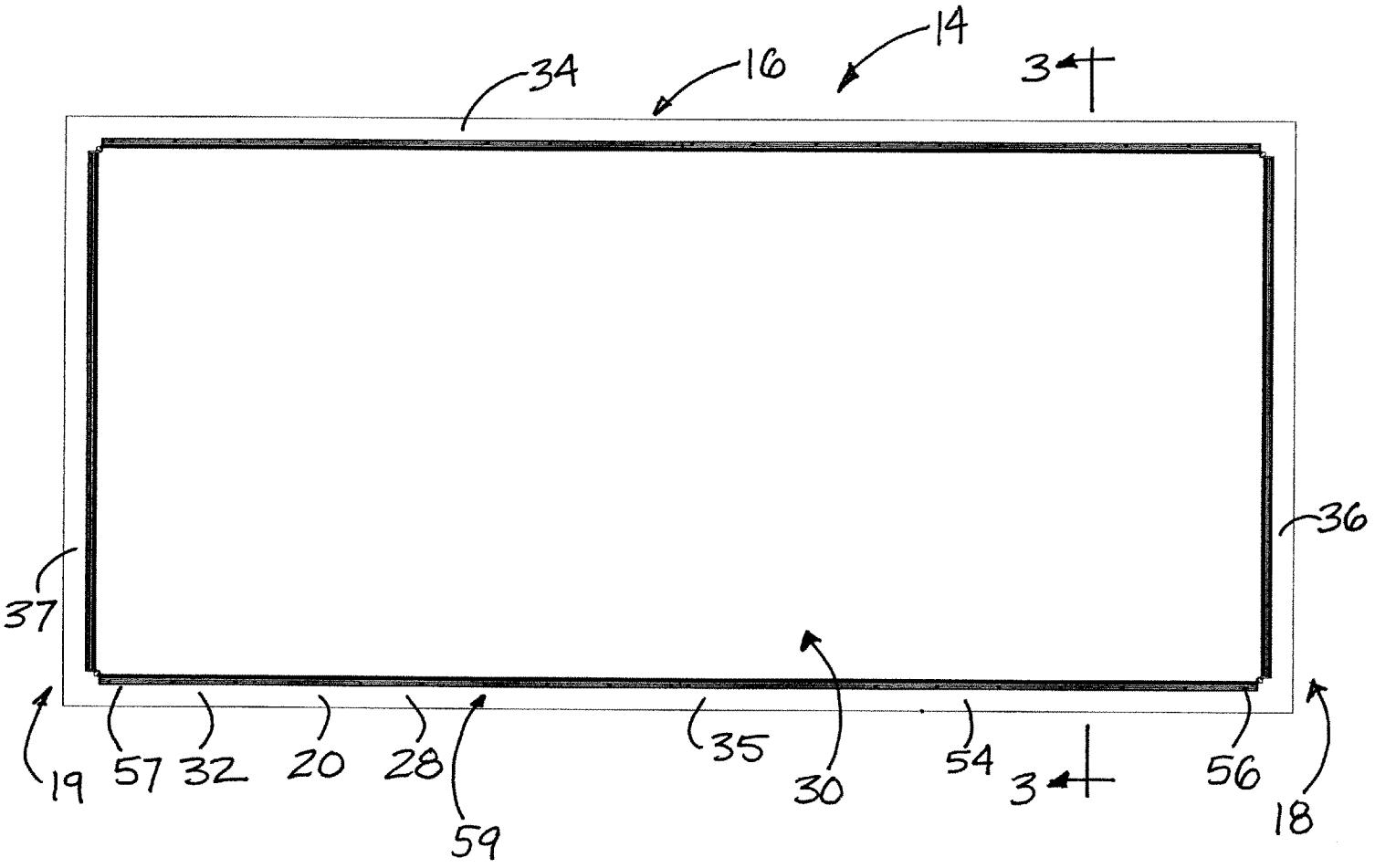
FIG. 2 is a schematic side view of support frame with a panel mounting assembly of the system, according to an illustrative embodiment.
Figure 3:
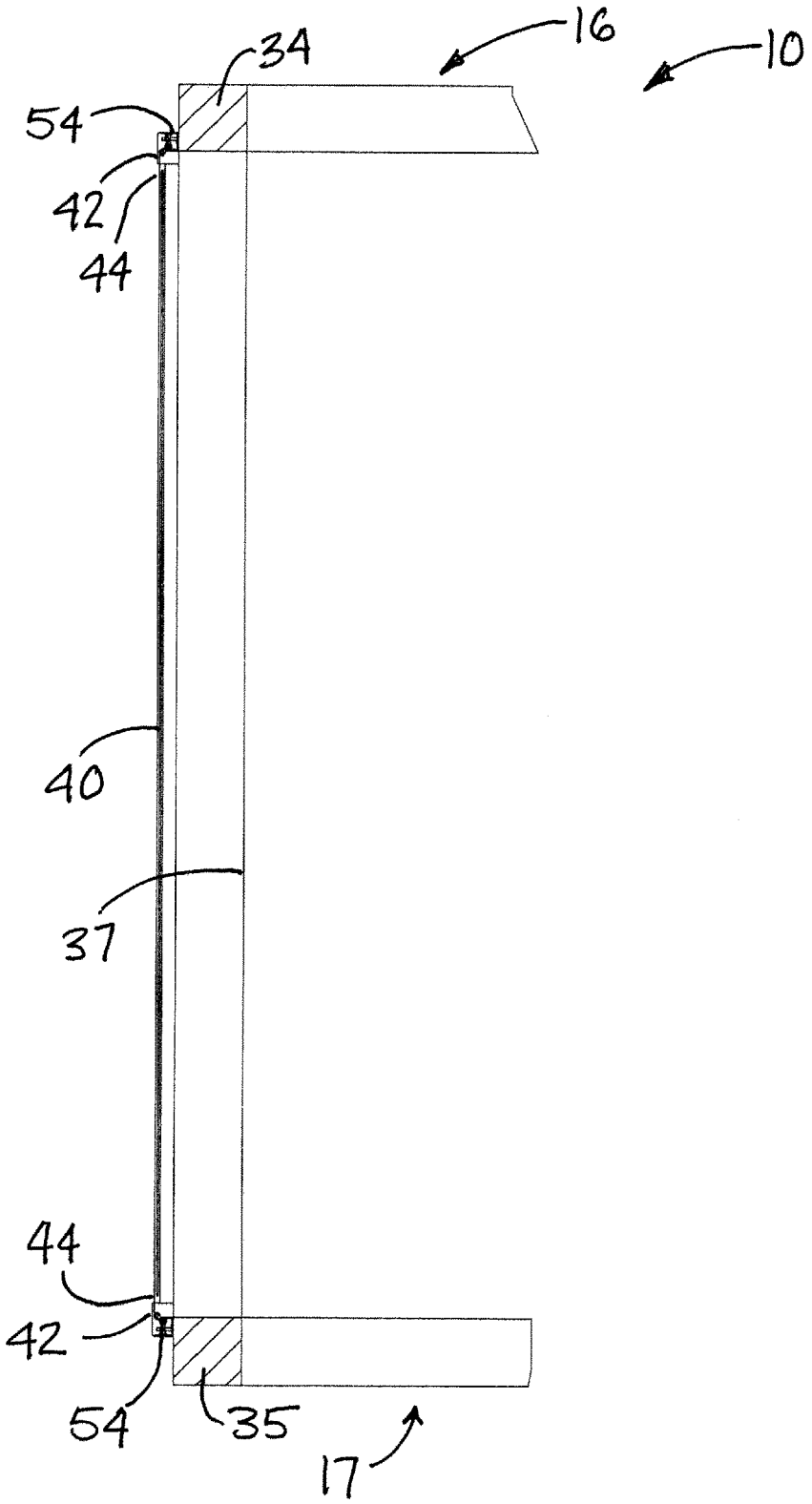
FIG. 3 is a schematic sectional view of a portion of the container taken along line 3-3 of FIG. 2, according to an illustrative embodiment.
Figure 4:
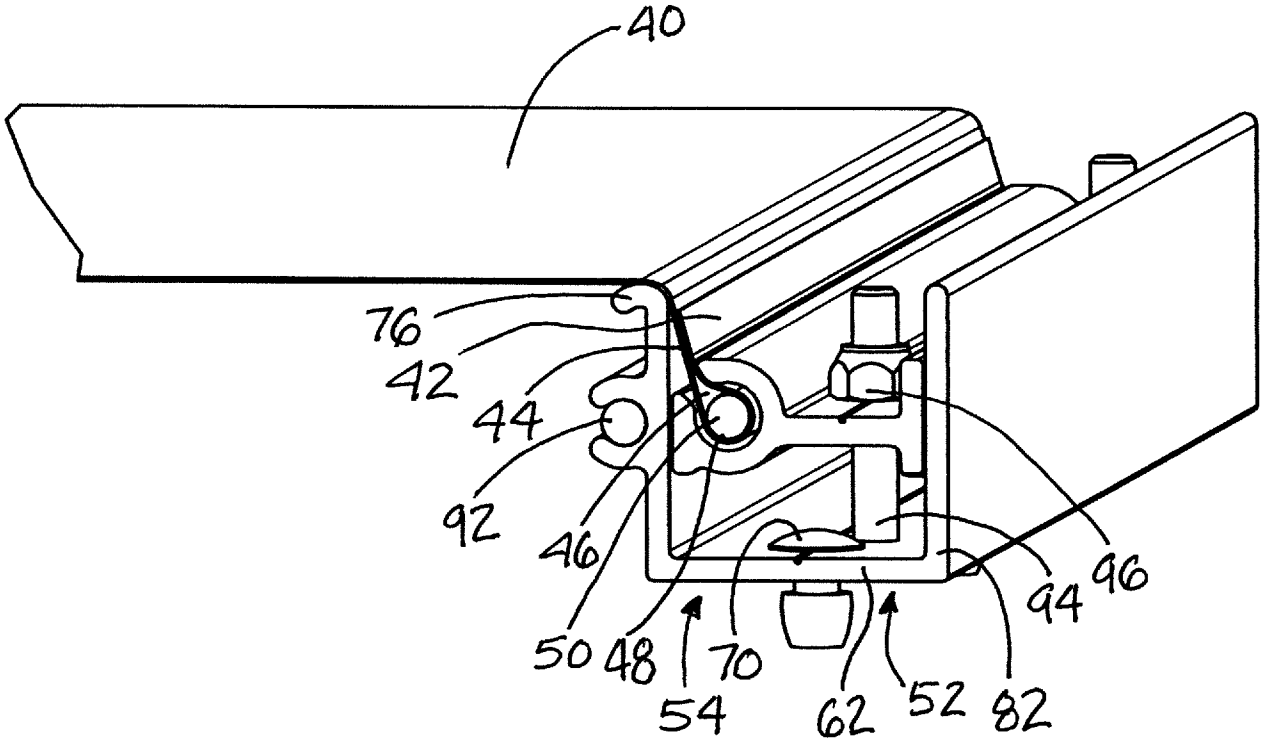
FIG. 4 is a schematic perspective view of a portion of the panel and panel mounting element, according to an illustrative embodiment.
Figure 5:
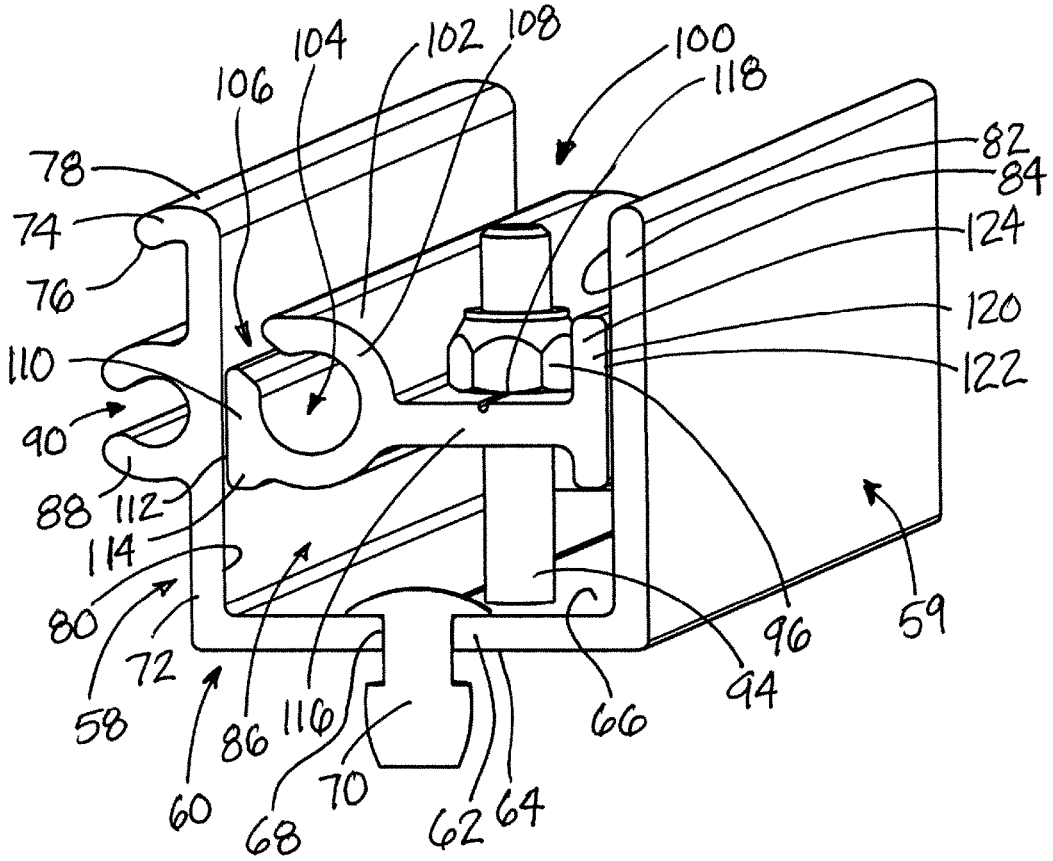
FIG. 5 is a schematic sectional view of the panel mounting element, according to an illustrative embodiment.

With reference now to the drawings, and in particular to FIGS. 1 through 5 thereof, a new enclosed container with removable sides embodying the principles and concepts of the disclosed subject matter will be described.

The applicants have recognized that some containers contain cargo or objects that do not need to be removed from the interior of the container that they occupy, and may be permanently mounted on the container interior. However, the objects may need to periodically be inspected and may also need to be repaired, requiring access to the objects. As an illustrative example, multiple natural gas or propane tanks may be mounted on a mobile base, such as a vehicle or a trailer towed by a vehicle, to permit easy portability of the tanks and their contents from site to site. A container may be provided to enclose the tanks to protect the tanks from the environment when moving on the road and when stationary on a site. Since the multiple tanks do not need to be removed from the container during normal use, the tanks are permanently mounted in the interior and are typically relatively closely packed together for efficient use of the interior space. However, the tanks and their associated apparatus do need to be inspected periodically, such as on an annual basis. Due to the close packing and permanent mounting of the tanks in the container, inspection of the tanks in the interior is difficult if not impossible to perform in a satisfactory manner.

The applicants have also recognized that the ability to temporarily "remove" one or more sides of the container would provide the ability to periodically inspect the tanks in a more effective and efficient manner. However, complex mechanisms for removing the sides which add weight and cost to the container simply for the purpose of enabling inspections that occur only at significant time intervals is not efficient. Moreover, the applicants understand that in applications such as the enclosure of permanently mounted tanks, the sides of the container are not provided to secure the contents in the container so much as to provide protection to the contents from environmental factors. Thus, panels may be used for the container sides that are not structural and do not secure the contents in the container but merely form an enclosure. While flexible panels formed of sheet material could provide this functionality, the applicants recognize that the panels would have to be maintained with sufficient tension so that air movement across and against the panels, whether the container is moving or stationary, would not cause disintegration of the panels. Maintaining sufficient tension on the panels, while facilitating easy removal during the time periods for inspection posed a problem. Panels formed of a sheet material not only wave under the influence of wind, but also tend to stretch once placed under tension and the stretching thus decreases the tension in the panel, thus requiring periodic readjustment of any structure supporting the panel to maintain sufficient panel tension.

In one aspect, the disclosure relates to a vehicle system 10 which includes a mobile base 12 which is configured to move over the ground surface, such as a road surface, between different site locations. In some embodiments, the mobile base 12 comprises a semi trailer configured to be towed by a semi-tractor, and in some embodiments the mobile base comprises a truck with a cab and a frame.

A container 14 may be utilized as a part of the system 10. For example, the container 14 may form a part of a semi trailer forming the mobile base, or the container may be mounted on the frame of a truck (or other vehicle) forming the mobile base. In other embodiments, the container 14 may be utilized independent of the elements of the system 10.

The container 14 may be configured to contain, and enclose or at least substantially includes, one or more objects positioned within an interior of the container. In some embodiments, the container has a cuboid, or rectangular parallelepiped, shape with a top 16, a bottom 17, and sides that broadly include a first end (or end side) 18, a second end (or end side) 19 located opposite of the first end, a first side 20, and a second side located opposite of the first side. Illustratively, the top and bottom of the container may extend substantially horizontally while the ends and sides may be substantially vertically oriented. In the illustrative containers of this description, the top 16 and bottom 17 may be formed by rigid roof and floor panels that may be nonremovable.

The container 14 may also include a support frame 26 configured to support the top 16 and sides 20, 21 and ends 18, 19 with respect to the bottom. The support frame 26 may have sides that generally correspond to the sides and ends of the container. The support frame 26 may form a cuboid space frame with at least one of the sides 20, 21 or ends 18, 19 of the space frame being open and having an opening 30. In some embodiments of the container, both ends and both sides of the frame 26 are open and are defined at their perimeters by portions of the support frame 26. The support frame may be formed by a plurality of frame members 28 which are formed or assembled into the space frame and provide a perimeter about each opening 30 in a side or end of the container. The frame members 28 for a side or end may have their ends connected together to form sides of a rectangular perimeter frame 32, and the corresponding opening 34 may also be substantially rectangular in shape. In greater detail, the perimeter frame of each side or end may include, for example, an upper frame member 34, a lower frame member 35, a left-sided frame member 36 and the right side frame member 37.

The container 14 may include a panel 40 for selectively closing each of the openings 30 on the sides and/or ends of the support frame. The panel 40 may have a periphery 42, and for substantially rectangular openings formed by a substantially rectangular perimeter frame, the periphery 42 may have a substantially rectangular shape. The panel 44 may have a peripheral section 44 located adjacent to and extending along the periphery 42, and may extend inwardly from the periphery toward the center of the panel.

A pocket 46 may be formed along at least a portion of the periphery of the panel, and may be formed by part of the peripheral section 44 of the panel being folded over upon itself. The pocket 86 may be elongated and extend parallel to the portion of the periphery. The pocket 46 may be substantially closed but may have open ends 48. The periphery of the panel may have a plurality of straight portions, and may include four straight portions arranged in a rectangular configuration. Correspondingly, some or all of the peripheral sections along the straight portions may each be formed into respective pockets 46 such that the panel may have four pockets positioned along the sides of the rectangular shaped panel.

In some embodiments, the panel 40 may be formed of a sheet material of relatively thin thickness that is able to be folded upon itself with the peripheral edge of the material being sewn or otherwise connected to an interior location on the panel to form the pocket. The panel may be flexible and may be formed of a flexible material that permits the folding and even rolling up of the material. While the material may exhibit some degree of stretchability, the most desirable materials may stretch only minimally in order to maintain a large degree of the tension applied to the panel.

A portion of the panel along the periphery may have a relatively thicker thickness along a line substantially parallel to the periphery. An elongated element 50 may be removably positioned in the pocket 46 to increase a thickness of a portion of the panel, and each pocket 46 may have an individual elongated element. The elongated element 50 may be flexible but may also exhibit a degree of rigidity. In some embodiments, the elongated element 50 comprises a cord of twisted or braided strands, but may also comprise a relatively more rigid configuration such as a wire. An elongated element 50 may be removably positioned in the pocket 46. Optionally, the material of the panel may be rolled and secured in the rolled condition to simulate the cord in the pocket providing the thicker thickness.

The container 14 may also include a panel mounting assembly 52 which is configured to removably mount one or more of the panels to the support frame for forming a portion of the enclosure or containment of the container. A plurality of the panel support assemblies 52 may be utilized with each being associated with a side or an end of the support frame to thereby removably mount a panel on the support frame in a location corresponding to the side or end of the container. The panel mounting assembly 52 may be mounted on a side or an end of the support frame, and each panel mounting assembly 52 may be comprised of one or more panel mounting elements 54, with a panel mounting element being positioned along a portion of the periphery of the panel being removably mounted on the support frame. Each panel mounting element 54 may be elongated with opposite ends 56, 57, and a length of the panel mounting element may be defined between the opposite ends. Each panel mounting element may be associated with one of the frame members of a perimeter frame of the support frame. Each panel mounting element may have an inboard side 58 for positioning toward the opening 30 of the side or end of the support frame, and each panel mounting element may have an outward side 59 for positioning away from the opening.

Each of the panel mounting elements may comprise a leverage structure 60 which is configured to provide leverage along at least a portion of the periphery of the panel to facilitate the application of tension to the panel. The leverage structure 60 may be elongated in the direction of the length of the panel mounting element. Illustratively, the portions of the leverage structure may be formed by a single extruded piece, although other configurations may be employed. The leverage structure 60 may include a base portion 62 which is configured to be positioned adjacent to the support frame, and may have an abutment face 64 for orienting toward and abutting against a frame member of the support frame. The base portions 62 may also have a base face 66 which is oriented opposite of the abutment face 64 for orienting outwardly away from the support frame. At least one hole 68 may be formed in the base portion 62 for receiving a fastener 72 to mount the leverage structure 62 to the corresponding frame member.

The leverage structure 60 may also include a fulcrum portion 72 which is configured to form a fulcrum edge 74 over which the peripheral section 44 of the panel 40 may be tensioned or otherwise held in a taut condition. The fulcrum portion 72 may include a lip 76 which may extend in the inward direction. The surface 78 of the fulcrum edge 74 may have a rounded cross sectional profile to facilitate sliding of the material the panel over the fulcrum edge. The fulcrum portion 72 may be positioned on the inward side of the mounting element 54. The fulcrum portion may extend from the base portion 62 and may be oriented substantially perpendicular to the base portion. The fulcrum portion 72 may have a first guide face 80 extending from the fulcrum edge 74 toward the base portion 62 and may extend to the base face 66.

The leverage structure 60 may also include a guide portion 82 which is positioned on the outward side of the mounting element 54. The guide portion 82 may extend from the base portion, and may be oriented substantially perpendicular to the base portion. The guide portion may be oriented substantially parallel to the fulcrum portion 72. The guide portion 82 may have a second guide face 84 which may be oriented in opposition to the first guide face 80 on the fulcrum portion. The second guide face 84 may be spaced from the first guide face, and may be oriented substantially parallel to the first guide face. The base portion, the fulcrum portion, and the guide portion may form a channel with a channel interior 86 being bounded by the base face 66 of the base portion, the first guide face 80 of the fulcrum portion, and the second guide face 84 of the guide portion.

The leverage structure 60 may also include a securing portion 88 which is configured to facilitate connection and alignment of the end of one leverage structure and the end of another adjacent leverage structure. The securing portion 88 may define a slot 90 which extends longitudinally with respect to the length of the mounting element 54 and I open at the ends of the leverage structure. A portion of a connecting pin 92 may be inserted into and extend between the slots of the securing portions 88 at the ends of adjacent leverage structures to help align the slots 90, and thereby the ends of the structures 60, with each other, particularly when the structures are attached to the same frame member of the support frame.

At least one post 94 may be mounted on the leverage structure 60 to extend into the channel interior 86 of the structure 60. The post 94 may be mounted on the base portion 62 of the leverage structure, and may extend substantially perpendicular to the base face 66. The post 94 may extend generally parallel to the first 80 and second 84 guide faces. At least a portion of the exterior surface of the post 94 may be threaded, and a nut 96 may be threadedly mounted on the threaded portion of the post so that rotation of the nut in a first rotational direction advances the nut toward the base portion 62 and rotation of the nut in a second (and opposite) rotational direction moves the nut away from the base portion. A plurality of the posts 94 may be provided on the leverage structure at substantially uniformly longitudinally spaced locations on the base portion 62.

Each of the panel mounting elements may also include a tensioning structure 100 which is configured to selectively apply tension to a portion of the panel in cooperation with the leverage structure 60. The tensioning structure may be configured to adjust a degree of tension applied to the panel, and may be movably mounted on the leverage structure 60 in order to vary to the degree of pulling force applied to the panel. The tensioning structure 100 may comprise a grip portion 102 which is configured to releasably gripping a portion of the periphery 42 or peripheral section 44 of the panel. The grip portion may define a passage 104 which may have an interior which is configured to receive a portion of the panel having an increased thickness, such as a portion of the peripheral section of the panel and a portion of the elongate element 50. The passage may extend longitudinally along at least a portion of the length of the tensioning structure. A slit 106 may be defined by the grip portion 102 and may extend from the interior of the passage to a location on and on the exterior of the tensioning structure to thereby permit a portion of the peripheral section of the panel to extend through the slit 106 while the pocket and the elongated element are positioned in the interior of the passage. The slit 106 may have a width that is less than the thickness of the portion of the panel having the relatively increased thickness, such as the thickness of the pocket 46 with the elongate element 50. At least part of the peripheral section 44 of the panel and the elongate element 50 are effectively trapped in the interior of the passage 104 to secure the tensioning structure 100 to the panel 40. In some embodiments, the grip portion 102 may comprise a substantially cylindrical wall 108 with a gap in the wall extending longitudinally along the length of the panel mounting element to thereby form the slit 106.

The tensioning structure 100 may also include a primary guide flange portion 110 for abutting against the fulcrum portion 72 of the leverage structure. The primary guide flange portion 110 may have a first abutment face 112 for abutting against the first guide face 80 of the fulcrum portion such that movement of the tensioning structure relative to the leverage structure generally occurs along a straight path parallel to the first guide face. The primary guide flange portion 110 may be at least partially integrated with the grip portion 102 of the tensioning structure, and in some embodiments may comprise a tab 114 which extends from the substantially cylindrical wall 108 of the grip portion.

The tensioning structure 100 may further include a mounting portion 116 which is configured to be mounted on the post 94. The mounting portion 116 may have an aperture 118 for receiving the post 94, and may include a plurality of apertures in a longitudinally spaced relationship such that each aperture receives one of the plurality of posts 94. The mounting portion 116 may be positioned between the nut 96 mounted on the post and the base portion 68 of the leverage structure such that rotation of the nut in the first rotational direction presses or urges the mounting portion of the tensioning structure to move toward the base portion to thereby increase tension in the panel. Conversely, rotation of the nut in the second rotational direction decreases pressure applied by the nut to the mounting portion 116 and as a result permits the mounting portion to move away from the base portion to thereby decrease tension in the panel area. In some embodiments, the mounting portion 116 is substantially planar and extends substantially parallel to the base portion 68 of the leverage structure.

The tensioning structure 100 may also comprise a secondary guide flange portion 124 for abutting against the guide portion 82 of the leverage structure. The secondary guide flange portion 120 may have a second abutment face 122 for abutting against the second guide face 84 of the guide portion to further guide movement of the tensioning structure with respect to the leverage structure in the channel interior 86. The second abutment face 122 may be oriented substantially parallel to the first abutment face 112 of the primary guide flange portion 110. The secondary guide flange portion may be mounted on the mounting portion at a location opposite of the grip portion 102 and the primary guide flange portion 110. In some embodiments, the secondary guide flange portion may include a flange wall 124 which may extend substantially parallel to the guide portion 82 of the leverage structure.

Illustratively, the leverage structure and tensioning structure may be formed of aluminum or other metal extrusion.

In use, the elements of the container may be manipulated in the following fashion in order to permit inspection of objects located in the interior of the container. The fastening nuts 96 may be removed from the corresponding posts 96 on the panel mounting elements 54 located on the horizontal lower frame member 35 as well as the vertical left 36 and right 37 frame members of the support frame 26 to release the tensioning structure 100 from the leverage structure 60 of each of these panel mounting elements. The tensioning structures 100 for the panel mounting elements corresponding to the left 36 and right 37 frame members may be removed from the panel 40 by sliding the tensioning structures in a longitudinal direction such that the pocket 46 and elongated element 50 are slipped or moved out of the interior of the passage 104. Removal of the panel mounting elements from the vertical extents of the periphery 42 of the panel permits the panel to be rolled about the tensioning structure for the remaining horizontal panel mounting element and to be moved in an upward direction toward the panel mounting element corresponding to the upper frame member (if employed on the container). The tensioning structure with the panel rolled thereabout may be positioned on the top 16 of the container while inspection of the container contents is conducted through the opening 30 of the support frame that has been exposed by the partial removal of the panel. Optionally, the panel could be completely removed from the support frame by removal of the nuts 94 from the posts 96 located on the horizontal upper frame member 34 as well. This process may be repeated for each of the panels located on each of the sides and ends of the container as needed.

Reinstallation of the panel on the side of the container may be accomplished by reversing the steps of the process, including unrolling the panel from the tensioning structure, remounting the tensioning structures on the vertically extending sections of the panel periphery, and remounting of the nuts on the posts after the polls have been reinserted through the apertures 118 of the tensioning structure. Periodic monitoring of the tension on the panel 40 may reveal the need to further tighten the nuts on the posts to maintain sufficient tension on the panel to avoid excessive and possibly damaging movement of the panel by environmental factors such as wind.

It will be recognized that the mounting of the panel to the upper frame member 34 could be accomplished by structure other than a panel mounting element of the disclosure, although use of a panel mounting element along all portions of the periphery of the panel permits relatively easy and quick replacement of the panel 40 should it become damaged or worn or otherwise compromised.

Advantageously, the panels 40 of the container may be significantly lighter in weight and less expensive than conventional metal sides of a semi trailer while providing the desired ability to inspect objects permanently mounted in the interior of the container. Panels mounted with the panel mounting assembly 52 are also quickly and easily replaced. Moreover, panels with different graphics may be replaced with significantly greater ease than repainting the container, and may even be rotated among containers if desired.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that steps set forth in the description and/or shown in the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A container configured to contain at least one object in an interior, the container having a top, a bottom, a first side, a second side opposite of the first side, a first end side, and a second end side opposite of the first end, the container comprising:

a support frame with sides corresponding to the sides of the container, at least one of the sides being an open side defining an opening, the open side of the support frame comprising a perimeter frame extending about an opening and defining a side plane, the perimeter frame including a plurality of frame members positioned at the side plane and forming a substantially rectangular shape, a flexible panel configured to at least partially cover the open side of the support frame, the panel having a periphery and a peripheral section located adjacent and along the periphery, the peripheral section including a plurality of portions, the flexible panel having a substantially rectangular shape generally corresponding to the substantially rectangular shape of the perimeter frame with each portion of the peripheral section of the panel being positioned along one side of the substantially rectangular shape, each side of the substantially rectangular panel having a length defined by a distance between two other opposite said sides of the substantially rectangular panel, at least one said portion of the peripheral section having a thicker thickness relative to a thickness of a remainder of the panel;

a panel mounting assembly configured to removably mount the panel over the opening of the open side of the support frame, the panel mounting assembly comprising at least one panel mounting element defining a channel having a channel interior and a channel opening located at the side plane, said at least one portion of the peripheral section of the panel extending through the channel opening and into the channel, the panel mounting element comprising:

a leverage structure forming a fulcrum edge along at least a portion of the perimeter frame of the open side of the support frame, said at least one portion of the peripheral section of the panel being tensionable over the fulcrum edge; and a tensioning structure mountable on the leverage structure and positioned in the channel interior of the channel of the at least one panel mounting element, the tensioning structure being configured to selectively apply an adjustable degree of tension continuously along an entirety of the length of the side of the substantially rectangular panel corresponding to said at least one portion of the peripheral section of the panel extending over the fulcrum edge of the leverage structure.

2. The container of claim 1 wherein the channel interior being at least partially exposed through the channel opening.

3. The container of claim 1 wherein the tensioning structure is movably mounted on the leverage structure such that movement of the tensioning structure with respect to the leverage structure varies the degree of tension applied to the panel.

4. The container of claim 3 wherein the leverage structure forms a first guide face and the tensioning structure forms a first abutment face, the first abutment face being configured to abut against the first guide face to guide movement of the tensioning structure with respect to the leverage structure.

5. The container of claim 1 wherein the leverage structure includes a base portion configured to be mounted on the support frame, and a fulcrum portion extending from the base portion and having the fulcrum edge formed thereon.

6. The container of claim 5 wherein the leverage structure includes a guide portion extending from the base portion, the fulcrum portion forming a first guide face and the guide portion forming a second guide face in opposition to the first guide face.

7. The container of claim 6 wherein the first and second guide faces are oriented substantially parallel to each other.

8. The container of claim 6 wherein the base portion, the fulcrum portion, and the guide portion of the leverage structure forms a channel with a channel interior, the tensioning structure being removably positioned in the channel interior.

9. The container of claim 1 wherein the panel mounting element comprises at least one post mounted on the leverage structure and engaging the tensioning structure.

10. The container of claim 9 wherein the at least one post extends through an aperture of the tensioning structure, a portion of the post being threaded and a nut being threadedly mounted on the post such that a position of the nut adjusts a degree of tension applied by the tensioning structure to the panel.

11. The container of claim 10 wherein the at least one post comprises a plurality of posts extending through a plurality of apertures in the tensioning structure.

12. The container of claim 1 wherein the at least one portion of the peripheral section having the thicker thickness comprises a pocket formed along at least a portion of the periphery and an elongated element positioned in the pocket.

13. The container of claim 12 wherein the tensioning structure comprises a grip portion configured to grip the at least one portion of the peripheral section having the thicker thickness.

14. The container of claim 13 wherein the grip portion is configured to releasably grip the at least one portion of the peripheral section having the thicker thickness.

15. The container of claim 1 wherein the panel mounting assembly for a said open side of the support frame includes at least three panel mounting elements, each of the panel mounting elements being associated with one of the frame members of the perimeter frame.

16. The container of claim 1 wherein a plurality of the sides of the support frame is a said open side defining a said opening, a said panel mounting assembly and a said panel being associated with each of the open sides.

17. A container configured to contain at least one object in an interior, the container having a top, a bottom, a first side, a second side opposite of the first side, a first end side, and a second end side opposite of the first end, the container comprising:

a support frame with sides corresponding to the sides of the container, at least two of the sides being open sides and each defining an opening, the open sides of the support frame each comprising a perimeter frame extending about an opening and defining a side plane, the perimeter frame including a plurality of frame members positioned at the side plane and forming a substantially rectangular shape, a plurality of flexible panels each configured to at least partially cover one of the open sides of the support frame, each panel having a periphery and a peripheral section located adjacent and along the periphery, the peripheral section including a plurality of portions, at least one portion of the peripheral section having a thicker thickness relative to a thickness of a remainder of the panel;

a panel mounting assembly configured to removably mount a said panel over the opening of one of the open sides of the support frame, the panel mounting assembly comprising at least three panel mounting elements, at least one of the at least three panel mounting elements defining a channel having a channel interior and a channel opening located at the side plane, at least one of the plurality of portions of the peripheral section of the panel extending through the channel opening and into the channel, the at least one panel mounting element comprising:

a leverage structure configured to provide a fulcrum edge along at least a portion of the perimeter frame of the open side of the support frame, the at least one portion of the peripheral section of the panel being tensionable over the fulcrum edge; and a tensioning structure mountable on the leverage structure and positioned in the channel interior of the channel of the at least one panel mounting element, the tensioning structure being configured to selectively apply an adjustable degree of tension to the at least one portion of the peripheral section of the panel extending over the fulcrum edge of the leverage structure and into the channel interior;

wherein the adjustable degree of tension applied by the tensioning structure to the peripheral section of the panel in the channel is adjustable by use of a tool inserted into the channel interior through the channel opening at the side plane to engage the tensioning structure.

18. The container of claim 17 wherein the adjustable degree of tension applied by the tensioning structure to the peripheral section of the panel in the channel is applied by a fastener positioned in the channel interior adjacent to the tensioning structure, the fastener being accessible through the channel opening in the side plane; and wherein rotation of the fastener in a first rotational direction tends to move the tensioning structure in a first direction to increase tension applied to the flexible panel and rotation of the fastener in a second rotational direction tends to move the tensioning structure in a second direction to decrease tension applied to the flexible panel.

19. The container of claim 17 wherein the flexible panel has a substantially rectangular shape, and each portion of the plurality of portions of the peripheral section of the panel is positioned along one side of the rectangular flexible panel; and wherein the tensioning structure of the panel mounting assembly applies tension to the flexible panel continuously along the side of the rectangular flexible panel corresponding to the at least one panel mounting element.

20. A container configured to contain at least one object in an interior, the container having a top, a bottom, a first side, a second side opposite of the first side, a first end side, and a second end side opposite of the first end, the container comprising:

a support frame with sides corresponding to the sides of the container, at least one of the sides being an open side defining an opening, the open side of the support frame comprising a perimeter frame extending about an opening and defining a side plane, the perimeter frame including a plurality of frame members positioned at the side plane and forming a substantially rectangular shape, a flexible panel configured to at least partially cover the open side of the support frame, the panel having a periphery and a peripheral section located adjacent and along the periphery, the peripheral section including a plurality of portions, at least one portion of the peripheral section having a thicker thickness relative to a thickness of a remainder of the panel;

a panel mounting assembly configured to removably mount the panel over the opening of the open side of the support frame, the panel mounting assembly comprising at least one panel mounting element defining a channel having a channel interior and a channel opening located at the side plane, at least one of the plurality of portions of the peripheral section of the panel extending through the channel opening and into the channel, the panel mounting element comprising:

a leverage structure configured to provide a fulcrum edge along at least a portion of the perimeter frame of the open side of the support frame, the at least one portion of the peripheral section of the panel being tensionable over the fulcrum edge; and a tensioning structure mountable on the leverage structure and positioned in the channel interior of the channel of the at least one panel mounting element, the tensioning structure being configured to selectively apply an adjustable degree of tension to the at least one portion of the peripheral section of the panel extending over the fulcrum edge of the leverage structure and into the channel interior;

wherein the adjustable degree of tension applied by the tensioning structure to the peripheral section of the panel in the channel is applied by a fastener positioned in the channel interior adjacent to the tensioning structure, the fastener being accessible through the channel opening in the side plane;

wherein rotation of the fastener in a first rotational direction tends to move the tensioning structure in a first direction to increase tension applied to the flexible panel and rotation of the fastener in a second rotational direction tends to move the tensioning structure in a second direction to decrease tension applied to the flexible panel.

* * * * *